US005699962A

United States Patent [19]

Scott et al.

[11] Patent Number: 5,699,962

[45] Date of Patent: Dec. 23, 1997

[54] AUTOMATIC ENGAGEMENT NOZZLE

[75] Inventors: Loren W. Scott, Carlsbad; Kurt Kulberg, La Jolla, both of Calif.

[73] Assignee: Hunter Industries, Inc., San Marcos, Calif.

[21] Appl. No.: 540,246

[22] Filed: Oct. 6, 1995

Related U.S. Application Data

[63] Continuation-in-part of Ser. No. 178,498, Jan. 7, 1994, Pat. No. 5,456,411.

[51] Int. Cl.[6] ..... B05B 1/02

[52] U.S. Cl. ..... 239/73; 239/74; 239/391

[58] Field of Search ..... 239/71, 73, 74, 239/203, 206, 236, 255, 390, 391, DIG. 1

[56] References Cited

U.S. PATENT DOCUMENTS

| | | | |
|---|---|---|---|
| 2,388,093 | 10/1945 | Smith | 239/71 X |
| 2,619,381 | 11/1952 | Jepson | 239/71 X |
| 2,991,942 | 7/1961 | Rosenkranz | 239/DIG. 1 X |
| 3,779,462 | 12/1973 | Bruninga | 239/390 X |
| 3,799,453 | 3/1974 | Hart | 239/391 X |
| 4,235,379 | 11/1980 | Beamer | 239/390 X |
| 4,540,125 | 9/1985 | Gorney et al. | 239/DIG. 1 X |
| 4,570,858 | 2/1986 | Bintner et al. | 239/71 X |
| 5,299,742 | 4/1994 | Han | 239/206 |
| 5,456,411 | 10/1995 | Scott et al. | 239/73 |
| 5,598,977 | 2/1997 | Lemme | 239/DIG. 1 X |

*Primary Examiner*—Lesley D. Morris

*Attorney, Agent, or Firm*—Baker, Maxham, Jester & Meador

[57] ABSTRACT

A sprinkler unit having a system of nozzles for a wide range of conditions, comprises a housing having an inlet for connecting to a source of water, an outlet, a passage connecting the inlet to the outlet, the outlet having a nozzle receiving socket, a nozzle for detachably mounting in the outlet, a latching device in the socket for latching engagement with the nozzle for retaining the nozzle in the socket.

20 Claims, 2 Drawing Sheets

AUTOMATIC ENGAGEMENT NOZZLE

REFERENCE TO RELATED APPLICATIONS

The present application is a continuation-in-part of application Ser. No. 08/178,498, filed Jan. 7, 1994 now U.S. Pat. No. 5,456,411, entitled QUICK SNAP NOZZLE SYSTEM.

BACKGROUND OF THE INVENTION

The present invention relates to irrigation sprinklers and pertains particularly to an improved snap in sprinkler nozzle.

The artificial distribution of water through irrigation systems is in wide use throughout the world today. There are many irrigation systems utilized, with each having its own benefits and drawbacks.

One of the most widely used systems, particularly where water is not abundant or plentiful, is the sprinkler system wherein a plurality of sprinkler units are positioned about a land area for distributing water over the surface of the land area. Such systems are widely used for lawns, golf courses, playing fields and many field crops.

Most sprinkler units currently used have replaceable nozzles wherein different nozzles may be selected and mounted in the sprinkler unit to achieve desired range and rate of coverage. A given irrigation system may have many different sprinkler units of the same type, with each having many different nozzles. It may also be desirable or necessary to change nozzles often for a given area to obtain an optimum precipitation rate or area of coverage. It is also desirable that an installer be able to stock one model of sprinkler unit and select the nozzle for coverage after the sprinkler unit is installed. In the parent application a quick snap nozzle system is disclosed wherein selected nozzles may be quickly and easily installed in and removed from a sprinkler unit. However, a simpler more effective nozzle mounting system is desirable.

Accordingly, it is desirable that a sprinkler system be available having a plurality of sprinkler nozzles that are simple and inexpensive to manufacture and are easily replaceable for providing desired coverage over a wide range of arcs and spacings.

SUMMARY AND OBJECTS OF THE INVENTION

Accordingly, it is a primary object of the present invention to provide a sprinkler system with easily replaceable nozzles.

In accordance with the primary aspect of the present invention, a sprinkler system comprises sprinkler units having easy snap-in nozzles with a mounting socket having a portion that biases the nozzle to a latching position.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figure 1:
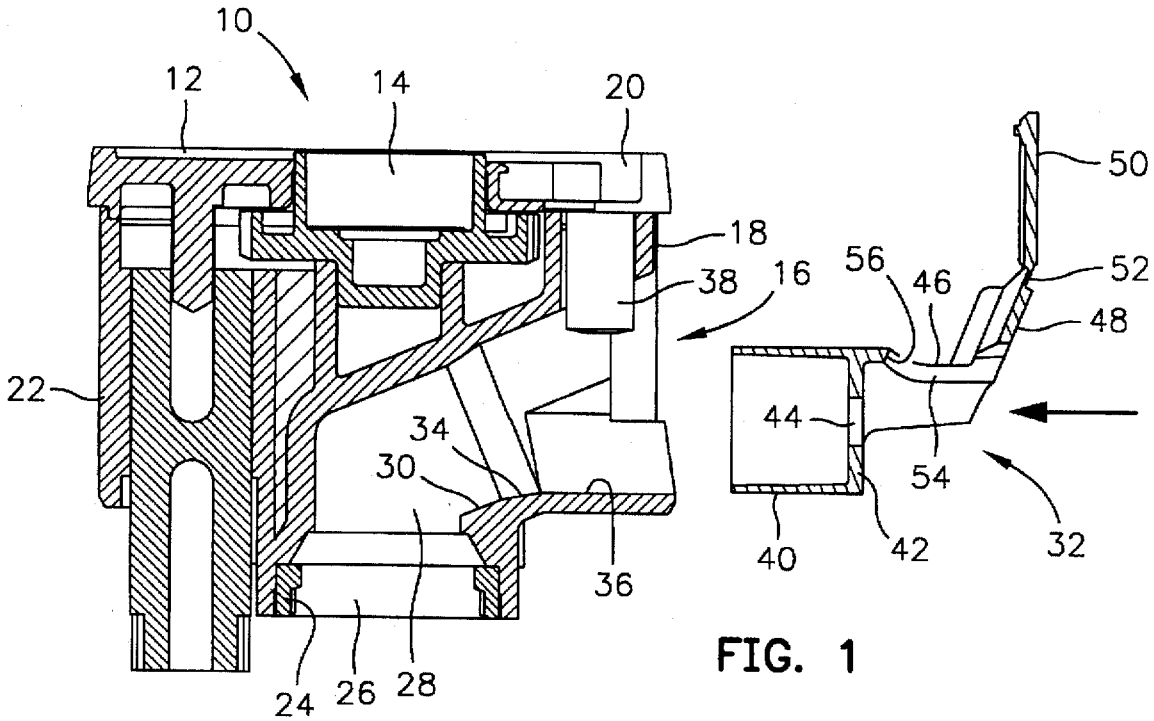
FIG. 1 is a side elevation view of a sprinkler unit embodying a preferred embodiment of the invention showing the nozzle positioned for insertion.

Referring to the drawings, particularly to FIGS. 1 through 4, there is shown a side elevation view in section of a sprinkler unit embodying the present invention with the nozzle in progressive stages of insertion. This sprinkler unit is of the type represented and disclosed for example in U.S. Pat. No. 4,568,024, entitled "Oscillating Sprinkler", granted Feb. 4, 1986 to the assignee of the subject application, said patent being incorporated herein by reference as though fully set forth. The sprinkler unit is turbine driven through a gear train that is reversible and has an adjustable arc. Certain units may be made full circle with or without a reversing drive. Other sprinkler units are variable arc from forty degrees up to about three-hundred sixty degrees.

A primary aspect of the present invention comprises an improved snap-in nozzle and mounting socket that is simple, easy and effective. Another aspect is a system wherein a system of the improved nozzles are provided for selectively providing a uniform coverage or precipitation rate for various arcs and ranges for the subject sprinkler units. The sprinkler unit, designated generally by the numeral 10, is preferably of the retractable pop-up type which is normally mounted within a housing below ground surface and pops up when in operation. However, it can be mounted as a fixed non-retractable unit in systems with retractable units.

Figure 5:
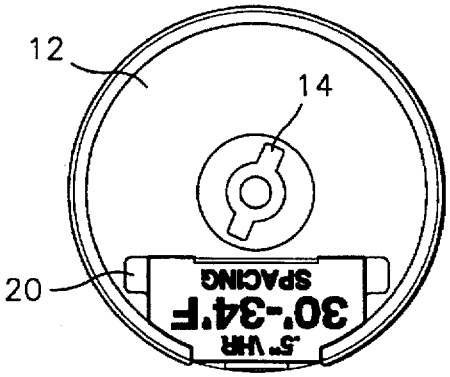
FIG. 5 is a top plan view of the sprinkler head of FIG. 1.

In the illustrated embodiment, the sprinkler unit has an oscillating head with a circular top 12, with a centrally located key way adjusting slot 14 in the center of a driving gear for receiving a special key or tool for rotating the adjustment device through a gear train as illustrated for adjusting the arc of oscillation of the sprinkler head. The distributor head of the sprinkler unit has a nozzle socket, designated generally at 16, with a slot 18 extending up the face thereof to a nozzle tab recess 20 formed in the top directly above the nozzle socket or port for receiving an indicator or indicia tab as shown in FIG. 5.

Referring to FIGS. 1–4, a portion of the head of the sprinkler unit 10 is illustrated in section view showing the main head components thereof. The head portion of the sprinkler unit comprises a main head body 22 mounted on an upper end of a tubular retractable housing (not shown) for rotation relative thereto. The head is mounted on the upper end of a rotatable tube 24, including a central through passage 26 communicating with an outlet passage 28 of the head.

Figure 4:
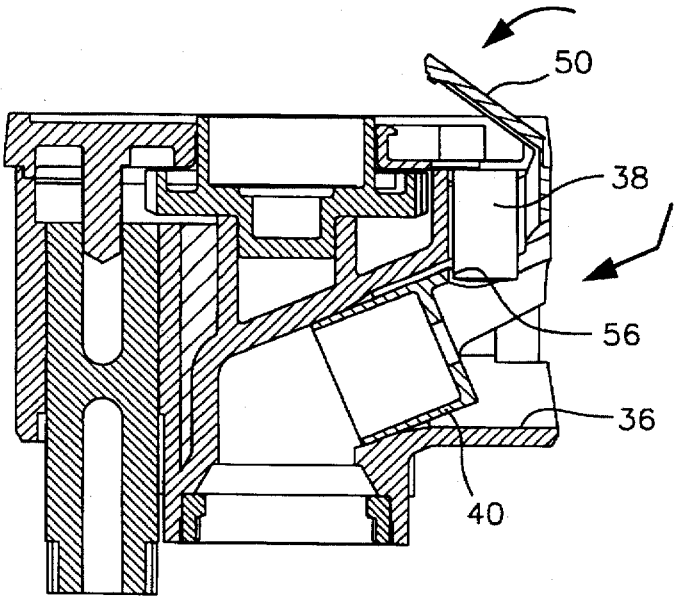
FIG. 4 is a view like FIG. 1 showing the nozzle in a final stage of insertion.

The outlet passage extends outward and upward at an appropriate angle. It is also formed to include a three stage nozzle receiving socket including generally cylindrical socket portion 30 for receiving the distal end of a tubular body portion of the snap-in nozzle designated generally at 32. A somewhat conical portion 34 of the socket forms a biasing or camming portion for biasing the nozzle into latching engagement as will be described. This portion 34 also forms a transition from the cylindrical portion 30 to a converging oval final outlet section 36. The oval portion has its main or long axis vertically oriented and its short axis horizontal and about equal to the diameter of the nozzle body. This configuration enables the nozzle to enter horizontally (FIG. 1) and then tilt upward for final latching (FIG. 4.).

The socket includes a latch member in the form of a screw 38 that adjustably projects into the outlet passage or socket at the upper outlet end thereof. This screw is positioned for engagement with a latch recess or shoulder on the nozzle body. The screw also performs the function of extending into the stream of water from the nozzle to break it up.

The snap-in nozzle units, as illustrated in FIGS. 1–4, have a generally tubular cylindrical main body portion 40, with an outlet end having an end wall or face 42 and a centrally positioned outlet orifice 44. An extension portion 46 extends forward with an upward portion 48 from the face of the nozzle and includes an indicia tab 50 attached thereto with a live hinge portion 52. A slot 54 is formed in the forward portion 46 and forms a shoulder 56 for latching engagement with or by screw 38 for retaining the nozzle in place in the socket. The tab 50 hinges over the top and snaps into the recess 20 as will be explained. The recess preferably has substantially the same general configuration as that of the tab.

Figure 2:
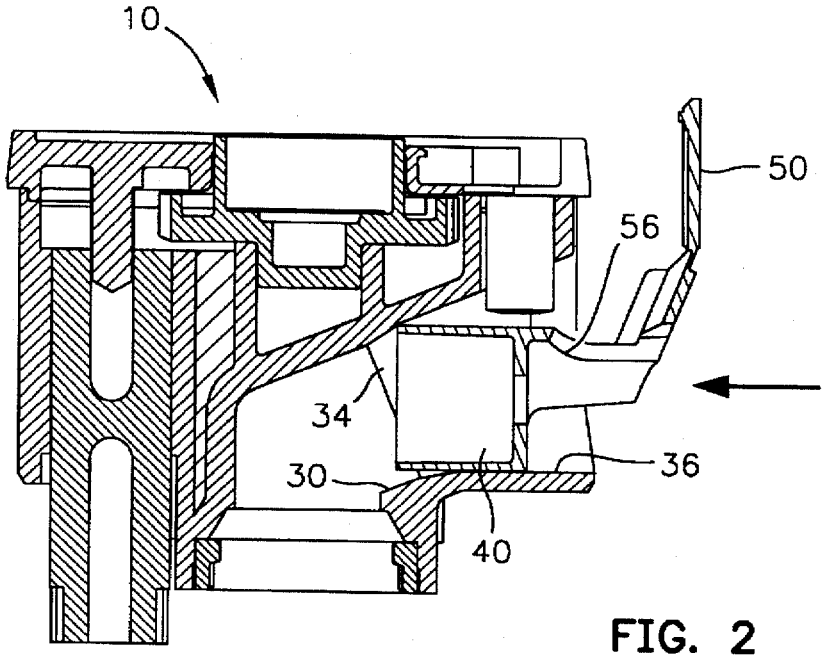
FIG. 2 is a view like FIG. 1 showing the nozzle in a first stage of insertion.
Figure 3:
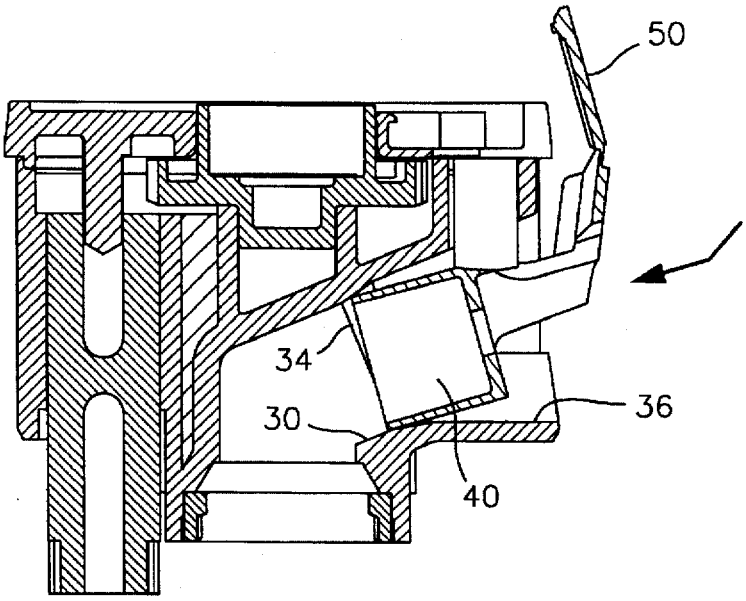
FIG. 3 is a view like FIG. 1 showing the nozzle in a second stage of insertion.

The nozzle 32 and socket 16 are formed for quick and easy installation and removal of a selected or desired nozzle. A selected nozzle is grasped by the tab and aligned with the socket as shown in FIG. 1. The nozzle is inserted along the lower wall portion 36 as shown in FIG. 2 until it reaches socket portion 34. At this position, further forward movement of the nozzle cams or forces the body 40 to tilt upward as seen in FIG. 3 to enable further movement. As the nozzle moves further in, the distal end enters cylindrical socket portion 30 and detent shoulder 56 engages latch screw 38, thereby latching the nozzle in place. The tab 50 may then be latched into its recess 20. The nozzle is removed by reversing the above procedure, tilting it downward and pulling it outward.

The tab recess 20 is wider than the slot 18 and may have ear portions as shown in FIG. 5. The indicia tab 50 is attached to or integral with the nozzles as illustrated in FIGS. 1–4, and extends to a position to the top of the sprinkler head where it may be latched into the tab recess and is visible from the top of the sprinkler unit at all times, including when the sprinkler is in its fully retracted position. The tab 50 may also serve as a retaining function to aid in retaining the snap-in nozzle in place.

The orifice 44 of the nozzle unit 32 is designed to distribute a specified predetermined rate of precipitation, such as 0.5 inches per hour over a given arc and range. Each nozzle is therefore designed for a particular range or spacing and arc of coverage. The range and rate of each nozzle is achieved by the design of the orifice, which is shaped and sized to provide a given range and rate for a given operating pressure. The subject units are designed to operate at a water pressure within the range of 25 to 75 psi. The orifice may be angled up or down to achieve range and may be made larger or smaller to achieve a desirable rate of precipitation.

The indicia tab 50 is designed to identify the nozzle and provide information to the installer of various parameters, including the precipitation rate, the spacing and the arc. In the exemplary embodiment, the arc is designated by the color of the tab which is readily visible from the top of the sprinkler unit. The color may be used in the alternative to show the precipitation rate and/or the spacing. As illustrated in FIG. 5, the precipitation rate of 0.5 inches per hour is printed on the tab along with the preferred spacing of thirty to thirty-four feet. Thus, for example, nozzles will be provided in quarter, half, three-quarter and full circle ranges of arcs. Each of these may be provided in sets of five or more nozzles, with the spacing ranging from thirteen feet up to thirty-four feet. These may also be provided in shorter spacings of about five feet up to thirty-five feet or so.

The nozzle sets may be provided on racks, that is, molded connected together for easy tear off and in colors, with the colors showing one of the parameters such as the arc. For example, a nozzle set having an arc range of from forty degrees to one-hundred thirty-five degrees may be provided in the color code brown. A half arc nozzle set may be provided in ranges of from one-hundred thirty-five degrees to two-hundred twenty-five degrees in a color code of green. A three-quarter nozzle set will be provided in an arc range from two-hundred twenty-five degrees to three-hundred fifteen degrees in a color code, for example, of blue.

A full circle nozzle set with arc ranges of from three-hundred fifteen degrees to three-hundred sixty degrees may be provided in a color code of black, for example. Each of these sets will have a nozzle for a spacing such as, thirteen to fifteen feet, a nozzle for spacing of sixteen feet to nineteen feet, a nozzle for spacing of twenty feet to twenty-four feet, a nozzle for spacing of twenty-five feet to twenty-nine feet, and a nozzle for spacing of thirty feet to thirty-four feet. Thus, a large range of matched nozzles providing a matched precipitation system is provided.

This nozzle system enables the easy selection and replacing of nozzles to achieve uniform precipitation and provides means for providing a spray uniformity over its spacing ranges. The two important parameters necessary for the installer in choosing nozzles are the arc and the spacing range required for each sprinkler. The quick snap nozzle system allows the installer to select from at least four nozzle sets of quarter, half, three-quarter and full, with at least the spacing ranges as specified above selectable for each arc. Other ranges can be easily provided with this system.

A nozzle of the desired parameters is selected and inserted into the nozzle housing and pushed all the way in to fully engage the screw 38 with shoulder 56. The nozzle identifier or indicia tab is then folded over and snapped into its receptacle or recess on the top of the sprinkler head.

Referring to FIGS. 1–4 the adjusting key way 14 is formed in the center of a pinion gear 58 which is rotatably mounted in a bore 60 in the distributor head body, and meshes with a gear, not shown, which adjusts the reversing stops for the drive gear. This adjusts the arc of oscillation of the sprinkler unit.

These sprinkler units, with quick engagement nozzles as pointed out above, permit the easy and economical installation of sprinkler systems for various plots of ground with minimal valving and controlling units and piping. For example, various shaped lawn areas can be laid out with a sprinkler system of the present invention with minimal complexity and with substantially uniform coverage.

This example illustrates the flexibility of the present system and the potential lay outs available. With this system, a matched precipitation can be easily provided throughout a complex geometric area to be irrigated. This can be done with less water piping, fewer control valves, and fewer controller or timers. Additional advantages include less scheduling of automatic timers.

While we have illustrated and described our invention by means of specific embodiments, it should be understood that numerous changes and modifications may be made therein without departing from the spirit and scope of the invention as defined in the appended claims:

We claim:

1. A sprinkler unit having a system of nozzles for a wide range of conditions, the sprinkler unit comprising:

a housing having an inlet for connecting to a source of water, an outlet, passage means connecting said inlet to said outlet, said outlet having means defining a nozzle receiving socket having an axis;

a nozzle for detachably mounting in said outlet for distributing a stream of water outward from said housing;

latching means in said nozzle receiving socket for latching engagement with said nozzle; and biasing means in said socket for biasing said nozzle and forcing it to tilt relative to said axis into latching engagement with said latching means for retaining said nozzle in said socket.

2. A sprinkler unit according to claim 1 wherein said latching means comprises a projection in said socket for engagement with a shoulder on said nozzle.

3. A sprinkler unit according to claim 1 wherein said biasing means is a wall in said socket that extends at an angle to an inlet wall of said socket.

4. A sprinkler unit according to claim 3 wherein said socket includes an oval outermost portion, a generally conical intermediate portion and a cylindrical innermost portion.

5. A sprinkler unit having a system of nozzles for a wide range of conditions, the sprinkler unit comprising:

a housing having an inlet for connecting to a source of water, an outlet, passage means connecting said inlet to said outlet, said outlet having means defining a nozzle receiving socket;

a nozzle for detachably mounting in said outlet for distributing a stream of water outward from said housing;

a latching protection in said nozzle receiving socket for latching engagement with a shoulder on said nozzle, wherein said projection is a screw adjustably extending into said socket; and biasing means in said socket for biasing said nozzle into latching engagement with said latching projection for retaining said nozzle in said socket.

6. A sprinkler unit according to claim 5 wherein said biasing means is a wall in said socket that extends at an angle to an inlet wall of said socket.

7. A sprinkler unit having a system of nozzles for a wide range of conditions, the sprinkler unit comprising:

a housing having an inlet for connecting to a source of water, an outlet, passage means connecting said inlet to said outlet, said outlet having means defining a nozzle receiving socket, wherein said socket includes an oval outermost portion, a generally conical intermediate portion and a cylindrical innermost portion, a nozzle for detachably mounting in said outlet for distributing a stream of water outward from said housing;

latching means in said nozzle receiving socket for latching engagement with said nozzle; and biasing means for biasing in said socket for biasing said nozzle into latching engagement with said latching means for retaining said nozzle in said socket.

8. A sprinkler unit according to claim 7 wherein said latching means comprises a projection in said socket for engagement with a shoulder on said nozzle.

9. A sprinkler unit according to claim 8 wherein said projection is a screw adjustably extending into said oval outermost portion of said socket.

10. A sprinkler unit according to claim 8 wherein said nozzle has a generally cylindrical tubular body having an end wall with an orifice, an outwardly projecting wall portion with a slot therein forming a shoulder for latching engagement with said latching means.

11. A sprinkler unit according to claim 10 wherein:

said body has a generally flat circular top with a tab receiving recess therein; and said nozzle has a tab that extends over said top and into said recess.

12. A sprinkler unit according to claim 11 wherein said sprinkler unit is an adjustable arc oscillating unit.

13. A sprinkler unit according to claim 11 wherein said sprinkler unit is an adjustable arc fixed head unit.

14. A sprinkler unit according to claim 13 wherein said generally conical intermediate portion of said socket defines said biasing means.

15. A sprinkler unit according to claim 11 wherein said sprinkler unit has a range of arc adjustment and includes multiple nozzles selectable for a predetermined rate of precipitation for selectable ranges of spacings over said range of arc adjustment.

16. A sprinkler unit having a system of nozzles for a wide range of conditions, the sprinkler unit comprising:

a housing having an inlet for connecting to a source of water, an outlet, passage means connecting said inlet to said outlet, said outlet having means defining a nozzle receiving socket having an axis;

a nozzle for detachably mounting in said outlet for distributing a stream of water outward from said housing;

latching means extending into said nozzle receiving socket for latching engagement with a shoulder on said nozzle; and biasing means in said socket for biasing said nozzle laterally relative to said axis into latching engagement with said latching means for retaining said nozzle in said socket.

17. A sprinkler unit according to claim 16 wherein said biasing means is a wall in said socket that extends at an angle to an inlet wall of said socket.

18. A sprinkler unit according to claim 17 wherein said socket includes an oval outermost portion, a generally conical intermediate portion and a cylindrical innermost portion.

19. A sprinkler unit according to claim 16 wherein said latching means is a screw adjustably extending into said socket, and said biasing means is a wall in said socket that extends at an angle to an inlet wall of said socket.

20. A sprinkler unit having a system of nozzles for a wide range of conditions, the sprinkler unit comprising:

a housing having an inlet for connecting to a source of water, an outlet, passage means connecting said inlet to said outlet, said outlet having means defining a nozzle receiving socket having an axis and a generally oval outermost portion;

a nozzle for detachably mounting in said socket for distributing a stream of water outward from said housing; and latching means in said nozzle receiving socket and on said nozzle for latching engagement upon tilting said nozzle relative to said axis.

* * * * *